United States Patent [19]

Lane

[11] 4,086,671

[45] May 2, 1978

[54] CONVERTIBLE SOFA BED

[76] Inventor: Manning Lane, 3185 Patrisal, Cincinnati, Ohio 45236

[21] Appl. No.: 761,965

[22] Filed: Jan. 24, 1977

[51] Int. Cl.[2] ..... A47C 17/14

[52] U.S. Cl. ..... 5/18 R; 5/29; 5/13

[58] Field of Search ..... 5/13, 17, 18, 29–37 R, 5/37 B, 191

[56] References Cited

U.S. PATENT DOCUMENTS

| | | | |
|---|---|---|---|
| 702,233 | 6/1902 | Moran | 5/37 B |
| 2,190,819 | 2/1940 | Andrews | 5/18 B |
| 2,597,860 | 5/1952 | Gerber et al. | 297/440 |
| 2,628,368 | 2/1953 | Gordon et al. | 5/18 R |
| 2,678,088 | 5/1954 | Jamison, Jr. | 297/440 X |
| 3,041,635 | 7/1962 | Holtzclaw | 5/18 R |
| 3,329,977 | 7/1967 | Heller | 5/37 R |

*Primary Examiner*—Casmir A. Nunberg
*Attorney, Agent, or Firm*—Melville, Strasser, Foster & Hoffman

[57] ABSTRACT

A sofa convertible into a bed comprising a back rest and arm support section mounting a horizontal stationary frame adapted to slidably receive two telescoping sections which may be withdrawn to provide a horizontal sleeping surface, a self-storing continuous one-piece mattress, and a folding foot board section.

23 Claims, 8 Drawing Figures

CONVERTIBLE SOFA BED

BACKGROUND OF THE INVENTION

1. Field of the Invention

The present invention relates generally to sofa type furniture and more particularly to a sofa which may be converted into a bed by means of retractable telescoping sections.

2. Description of the Prior Art

The increasing scarsity of living space and raw materials in modern times has placed increasing demands on more efficient utilization of utensils used by man. One approach to the conservation of resources problem has been to design man's living necessities in such a way that they may be used for more than one purpose. This principle has been applied in particular to furniture used by apartment dwellers who may find that crowded living conditions seriously interfer with their use of sleeping and sitting apparatus, particularly beds, sofas, etc. For example, residents of housing with minimal actual living area may find that there exists insufficient floor space to include both a bed and sofa. These persons have found it worthwhile to invest in furniture which can be used in a dual capacity, i.e., for sitting during the day and as a bed during the night. Many of these types of devices are known in the prior art and operate in various types of extensible, telescopic and foldable modes.

Unfortunately, many of these so-called sofa beds have suffered from drawbacks which have reduced their usefulness. For example, some of the convertible sofa beds contain complex mechanical mechanisms requiring frequent and expensive maintenance. Other types of sofa beds, because of the specific way in which the conversion takes place, may not be used in close proximity to other furniture, or may interfer with the particular room geometry. Still other types of sofa beds require vertical lifting of heavy retractable sections thereby precluding their use by persons unable to perform heavy lifting.

Individuals of greater than average height have also found conventional sofa beds uncomfortable for sleeping due to the limited length of the units necessitated by the nature of the folding or retracting mechanism employed. Furthermore, there has not been available heretofor an acceptable means for extending the sleeping length of an otherwise too short sofa bed.

Conventional sofa beds are generally constructed in single piece units which cannot be disassembled or "knocked-down" for shipment, resulting in higher transportation costs and waste of valuable carrier resources.

Another drawback to present convertible sleeping apparatus involves storage of the mattress while the apparatus is not being used as a bed. The problems associated with the storing of the mattress have resulted in sofa bed designs employing multiple piece mattresses or complicated folding arrangements for single piece mattresses. None of these approaches has proved entirely satisfactory. To overcome these drawbacks, the present invention provides a convertible sofa bed which may be used in crowded quarters, whose conversion is linear requiring minimal lifting, which provides means for extending the length of the sofa bed when used as a bed, which utilizes a self-stored single piece mattress, and which may be disassembled for ease of shipment.

SUMMARY OF THE INVENTION

The convertible sofa bed of the present invention comprises a stationary back rest and arm support section, a lower movable frame or first telescoping section, an upper movable frame or second telescoping section, and a foldable foot board section. The back rest and arm support section contains a stationary U-shaped support frame mounting a flexible mesh or other suitable support means hinged to the rear edge of the frame. The back rest and arm support section rests on the floor by means of four legs, one at each corner. The back rest and arm support section also comprises a vertical back rest frame and a pair of vertical arm rest frames. The stationary U-shaped support frame carries a horizontal rod-like guide member attached to the stationary frame. This rod-like guide member is slidably affixed to the first telescoping section which also carries a suitable spring matrix and is supported from the floor by caster carrying legs attached to each corner of the frame, this telescoping section being so adapted as to be able to easily slide beneath the hinged mesh of the stationary frame when the sofa bed is being utilized as a sofa, and being shiftable outwardly when the sofa bed is being used as a bed. The stationary rectangular frame carries a lazy-tong equilizer which maintains parallelism between the first telescoping section and the stationary frame. Attached to the stationary frame and sloping rearwardly and upwardly toward the upper edge of the vertical back rest frame are a number of rod-like members forming guides and supports for the mattress when the sofa bed is being used as a sofa.

The first telescoping section has affixed to its sides a number of guide rail supports which bear against and slidably support channel-shaped guide rails attached to a second telescoping section of construction similar to that of the first telescoping section. The second telescoping section is also supported by a pair of castered legs located at each of the front corners which enable the second telescoping section to be easily shifted inwardly and outwardly. When the convertible sofa bed is being used as a sofa, the second telescoping section is retracted above and parallel to the first telescoping section and stationary frame. In use as a bed, the second telescoping section shifts outwardly from the back rest and arm support section supported by the guide rail supports and the castered legs, assuming a position substantially coplanar with that of the first telescoping section when the second telescoping section is fully extended. The second telescoping section is retained in its fully extended position by an angled stop fashioned in the end of the guide rails.

In order to maintain parallelism between the first and second telescoping sections, the second telescoping section is provided with an equilizer in the form of lazy tongs connected between the first and second telescoping sections. The second telescoping section is also provided with a folding foot board which, when the telescoping sections are fully extended, may provide extra bed length. When in the retracted or sofa configuration, the foot board section is retracted to a position substantially parallel with the back rest frame and provides a kick plate for the sofa.

The convertable sofa bed may be partially disassembled to facilitate shipment. The vertical back rest frame is affixed to the arm rest frames by a pair of slotted brackets attached to each end of the back rest frame which engage a corresponding pair of pins extending from each arm rest frame. The back rest frame may be removed from the arm rest frames for shipment by lifting the back rest frame to disengage the pins from the bracket slots. The arm rest frames may be easily removed from the stationary frame by loosening and removing three wing nuts holding each arm rest frame to the stationary frame. Finally, the foot board section may be removed from the second telescoping section by removing a pair of nuts. This disassembly results in five parts (one part comprising the stationary frame, first telescoping frame and second telescoping frame, another part comprising the foot board section, one part comprising the back rest frame and two parts comprising the arm rest frames). These parts may be easily stacked to increase the number of units per unit volume for shipping.

The convertible sofa bed may also be provided with a one-piece mattress, preferably of a foam or other suitable material, which covers and is supported by the stationary frame, first telescoping section, and second telescoping section when the convertible sofa bed is in its extended or bed configuration, thereby providing a comfortable sleeping surface. When the convertible sofa bed is in its retracted or sofa configuration, a part of the mattress is folded upon itself, the end of the mattress nearest the vertical back rest support sliding upwardly along the slanting rod-like guide members, thereby providing unobtrusive storage and a comfortable seating surface. The mattress is aided in its folded position by a region of reduced density in the area of the fold, thereby permitting the mattress to be easily doubled back upon itself. When in the folded position, the mattress may be held in place by straps. Means may also be provided for cushions and appropriate upholstery for additional comfort and to improve the appearance of the sofa bed.

DESCRIPTION OF THE PREFERRED EMBODIMENTS

Figure 2:
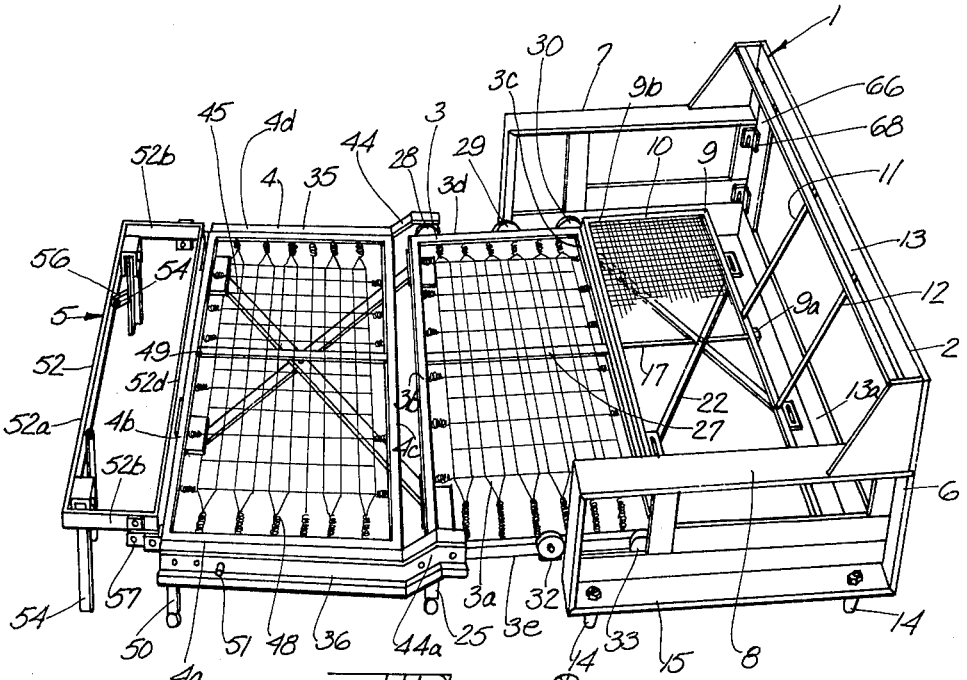
FIG. 2 is a perspective view of the sofa bed in its extended or bed configuration with the mattress removed.

The elements of the present invention which comprise the convertible sofa bed are best understood with reference to FIG. 2, which shows the sofa bed, generally indicated at 1, in its extended or bed configuration. The sofa bed consists of four sections, a stationary back rest and arm support section 2, a lower movable frame or first telescoping section 3, an upper movable frame or second telescoping section 4, and a foot board section 5. The operation of each of these sections will be described in detail hereinafter.

The stationary back rest and arm support section 2 comprises a vertical back rest frame 6, two vertical arm rest frames 7 and 8 which are ridgedly but removably affixed to the back rest frame 6, and a U-shaped stationary horizontal support frame 9 containing a flexible mesh or other suitable support means 10 and supported by the vertical arm rest frames 7 and 8. Support means 10 is attached along its rear edge only by rivets, screws or the like **10*a* to member 9*a* of stationary frame 9 so that the front edge of support means 10 may be lifted several inches above the plane of stationary frame 9, the rear attachment to frame member 9*a* together with the resiliency of support means 10 acting as a hinge. The sides of support means 10 normally rest upon stationary frame side members 9*b* and 9*c*. The front edge of support means 10 rests upon the rear frame member 3*c* of first telescoping frame section 3 when the sofa bed is in its bed configuration. However, as will be explained in more detail hereinafter, the front edge of support means 10 slidably rests upon spring means 3*a* of first telescoping frame section 3 when the sofa bed is in its sofa configuration and in the intermediate positions as first telescoping section 3 is slid beneath support means 10**.

Additional rigidity is afforded back rest frame 6 by means of stiffeners 66 and 67 disposed between the upper and lower rails 13 and **13*a* of frame 6. Stationary horizontal frame 9 also supports at its rear edge a pair of rod-like guide members 11 and 12 which slope rearwardly and upwardly and are affixed at their upper ends to the upper rail 13 of the back rest frame 6. These rod-like guide members provide support for the mattress section while the sofa bed is in its sofa configuration as will be described. The stationary back rest and arm support section 2 rests on the floor by means of four legs 14 attached to the bottom corners of the lower rails 15 and 16 of arm rest supports 7 and 8**.

Figure 3:
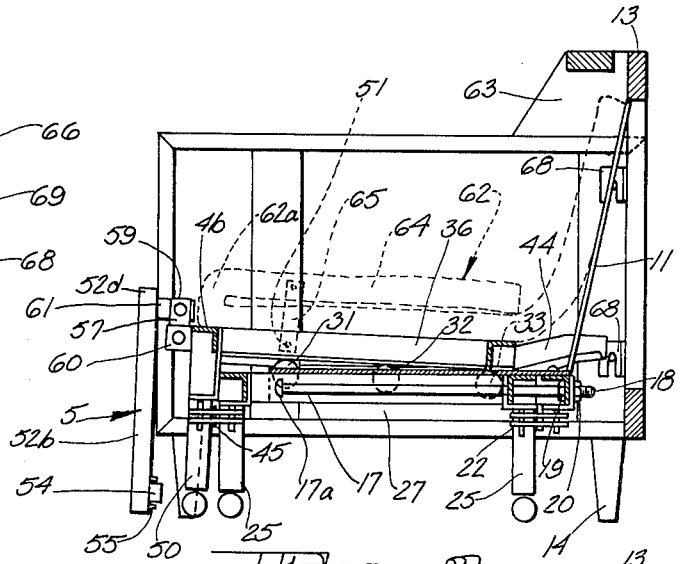
FIG. 3 is an elevational view, partly in cross section, of the sofa bed in its retracted or sofa configuration showing the folded mattress.
Figure 4:
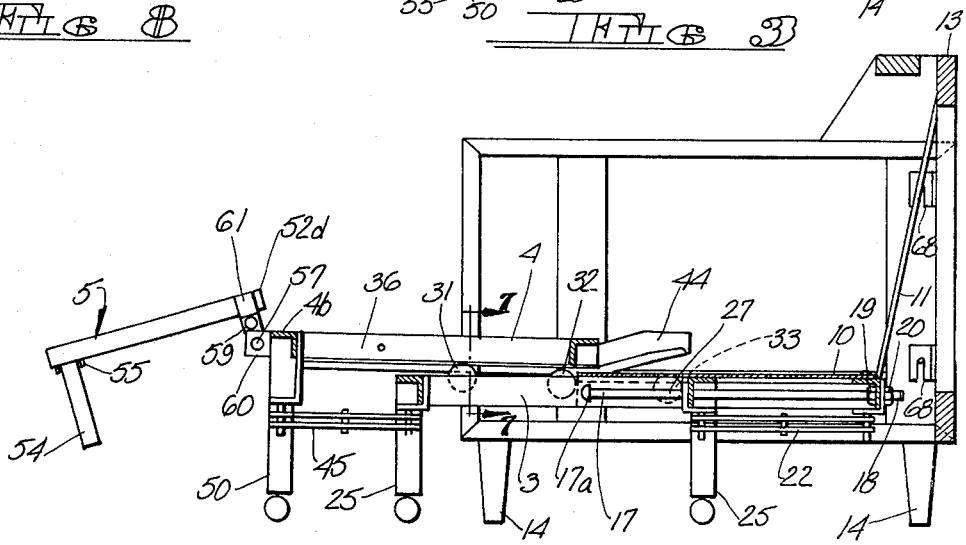
FIG. 4 is an elevational view, partly in cross section, showing the sofa bed in an intermediate extended position, with the mattress not shown for clarity and the foot board section legs partially unfolded.
Figure 5:
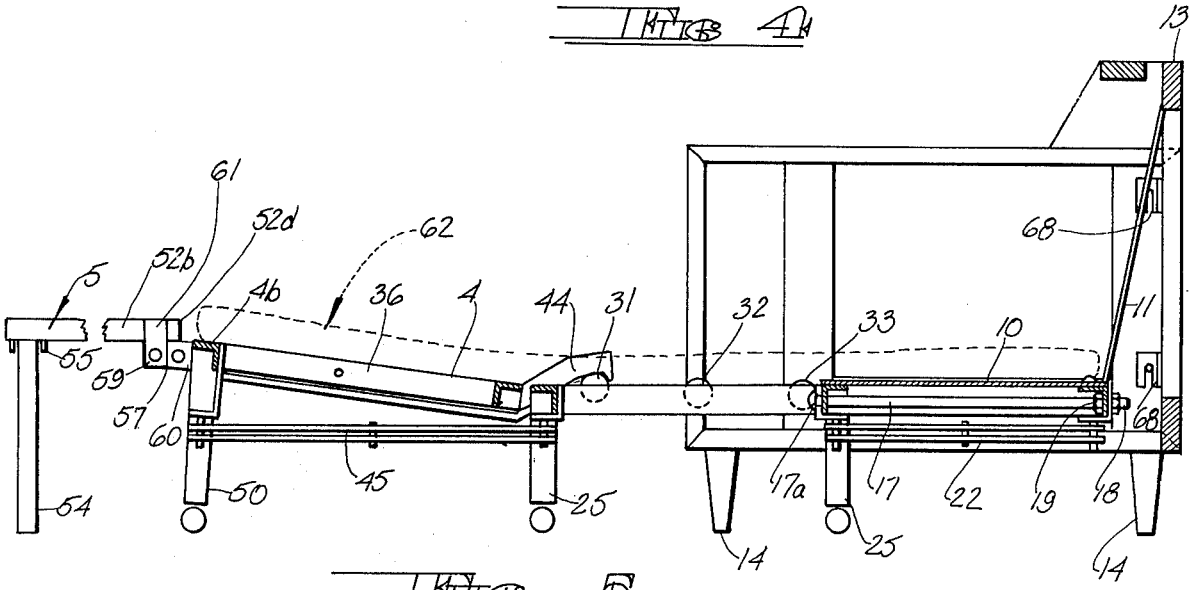
FIG. 5 is a fragmentary elevational view, partly in cross section, of the sofa bed of the present invention in its extended or bed configuration with the mattress in place.

As is best shown in FIGS. 3 through 5, stationary frame 9 carries a horizontal rod-like guide member 17 attached to the midpoint of stationary frame member **9*a*. The rearmost end of rod-like guide member 17 is threaded as at 18 and passes through a bore located in stationary frame member 9*a*. The rod-like guide member is rigidly held in place by a pair of adjusting nuts 19 and 20 positioned on each side of stationary frame member 9*a*, the function of which will be explained hereinafter. The free end of guide member 17 is fashioned in a flange or stop 17*a*, which may be mushroom-shaped as illustrated in FIGS. 3 through 5**.

Rod-like guide member 17 is slidably received in box-shaped guide enclosure 27. The end of enclosure 27 positioned nearest frame member **3*c* contains a restriction (not shown) which prevents guide member 17 from being fully withdrawn from enclosure 27. Enclosure 27 is rigidly affixed to frame members 3*b* and 3*c*, such that first telecoping section 3** may shift from its fully retracted position shown in FIG. 3, wherein first telescoping section 3 is positioned below and parallel to support means 10 to its fully extended position shown in FIG. 5 where first telescoping section 3 is substantially coplanar with support means 10. The interaction of stop 17*a* with the restriction contained in enclosure 27 prevents first telescoping section 3 from being fully withdrawn from beneath support means 10. By adjusting nuts 19 and 20 at the threaded end of guide member 17, the overlap between first telescoping section 3 and support means 10 may be varied so that support means 10 rests upon and is supported by frame member 3*c* when first telescoping section 3 is in its fully extended position.

Figure 6:
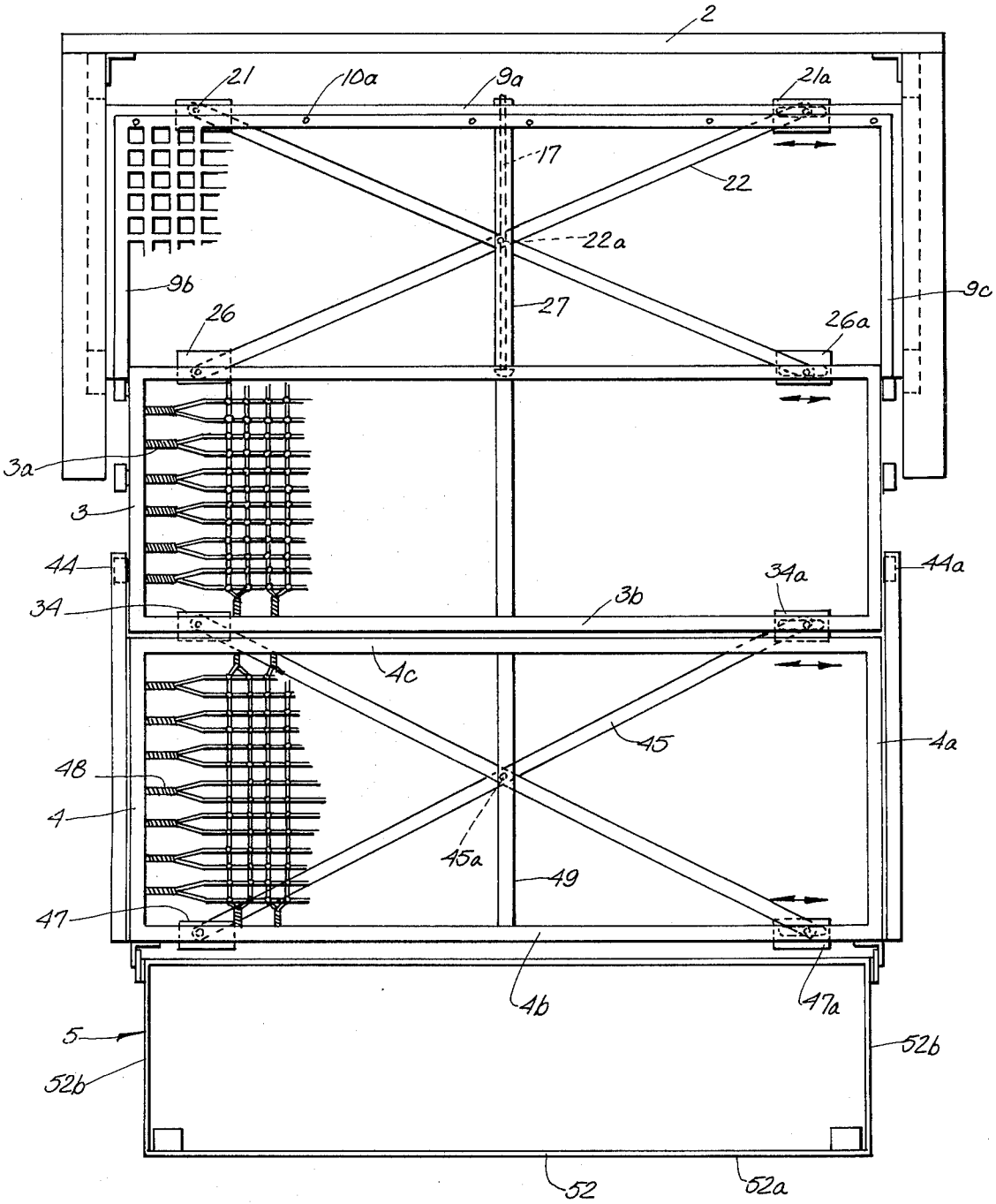
FIG. 6 is a fragmentary plan view of the sofa bed in its extended or bed configuration with the mattress removed.

First telescoping section 3 is supported from the floor by four caster-carrying legs 25, positioned at the four corners of section 3, which permit first telescoping section 3 to freely glide along the floor upon being removed from or inserted beneath support means 10. In order to maintain parallelism between stationary frame 9 and first telescoping section 3 during the retraction and extension operations, a lazy-tong equilizer 22, of a type well understood in the art, is attached at its rearmost verticies to a pair of brackets 21 and 21*a*, affixed to frame member 9*a*. Lazy-tong equilizer 22 is attached near its forward verticies to a pair of brackets 26 and 26*a* rigidly affixed near the rearmost corners of first telescoping section 3. Brackets 21 and 26 permit the vertices of equalizer 22 closest to frame member 9*b* to pivot freely, but prevent linear movement. Brackets 21*a* and 26*a* permit the vertices of equalizer 22 closest to frame member 9*c* to pivot as well as move parallel to frame member 9*a* in the directions shown in FIG. 6. The centers of each arm of equalizer 22 are connected by pivot pin 22*a*. The lazy-tong action of equalizer 22 assists in maintaining parallelism between first telescoping section 3 and stationary frame 9 during the retraction and extraction operations.

First telescoping section 3 also mounts a coiled spring matrix 3*a* of any suitable construction to provide comfortable sitting or reclining. Guide enclosure 27 also provides additional support for spring matrix 3*a*.

Figure 7:
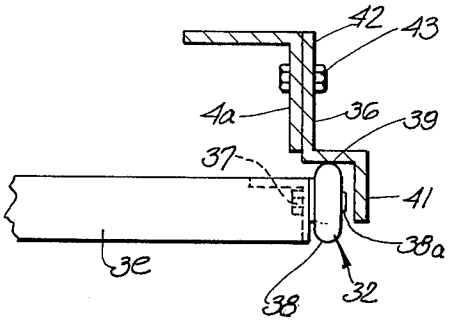
FIG. 7 is a cross-sectional view taken along section lines 7—7 of FIG. 4 showing the guide rail support detail.

First telescoping section 3 has affixed to its outer frame members 3*d* and 3*e* six guide rail supports 28 through 33, which support and guide second telescoping section 4. The guide rail supports 28 through 33 may be affixed to first telescoping section 3 by any suitable fastening means, such as bolts, rivets or the like, as at 37, as is most clearly shown in FIG. 7. While it is preferred that each of guide rail supports comprise a roller 38 of nylon, plastic, or other similar material, attached to first telescoping section 3 and having a shaft 38*a* upon which roller 38 is free to rotate, it is considered to be within the scope of the present invention that the guide rail supports 28 through 33 comprise generally D-shaped solid members of nylon, plastic or other suitable low friction material.

First telescoping section 3 also contains at the corners of frame member 3*b* a pair of brackets 34 and 34*a* which support the verticies of a second lazy-tong equilizer 45, as will be described hereinafter.

Guide rail supports 28, 29 and 30 support guide rail 35 which is rigidly affixed to one outermost edge of second telescoping section 4. In a similar manner, guide rail supports 31, 32 and 33 support guide rail 36 which is fixedly attached to the opposite outermost edge of the second telescoping section 4. Guide rail 36 comprises a member of generally Z-shaped cross-section (see FIG. 7) having a vertical leg 42 which is rigidly affixed to the downwardly depending leg 4*a* of second telescoping section 4 as at 43, a horizontal web portion 39 which rests against roller means 38, and a downwardly depending leg 41 which prevents roller means 38 from becoming disengaged from web portion 39 and also helps to maintain alignment between first and second telescoping sections 3 and 4. It will be understood that the remaining guide rail supports 32 and 33 operate will coact with guide rail 36 in a similar manner. Guide rail supports 28, 29 and 30 will similarly coact with their respective guide rail 35. The rearmost portions of guide rails 35 and 36 angularly offset as at 44 and 44*a* to provide a locking means for maintaining the sofa bed in its extended or bed configuration. When in the fully extended position, as shown in FIG. 5, the angularly disposed portions 44 and 44*a* of guide rails 35 and 36 rest on and are supported by forwardmost guide rail supports 28 and 31 respectively.

Parallelism between first telescoping section 3 and second telescoping section 4 is maintained by lazy-tong equilizer 45, the rearmost vertices of which are attached to brackets 34 and 34*a* located on frame member 3*b*, and the forwardmost vertices of which are attached to brackets 47 and 47*a* affixed near the forward corners of frame member 4*b*. Equilizer 45 operates in a manner similar to equilizer 22 as is well understood by those skilled in the art. Brackets 34 and 47 provide pivotal support for the vertices of equalizer 45 nearest frame member 4*d* while brackets 34*a* and 47*a* provide pivotal movement and movement parallel to frame 4*b* for the equalizer vertices nearest frame member 4*a*. The arms of equalizer 45 are connected at their midpoints by means of pivot pin 45*a*. In order to provide a comfortable sitting or lying surface, second telescoping section 4 contains a suitable spring matrix 48, which may be additionally supported by a reinforcing bar 49 affixed to the midpoints of second telescoping section frame members 4*b* and 4*c* beneath spring matrix 48.

Second telescoping section 4 is supported from the floor by a pair of castered legs 50 located at the forward corners of frame member 4*b*, which enable second telescoping section 4 to easily glide along the floor as the section is shifted between the sofa and bed configurations. It will be observed that second telescoping section 4 is approximately coplanar with second telescoping section 3, its slight slope having been exaggerated in FIG. 5 for clarity. Second telescoping section 4 also contains a pair of cylindrical rods or dowels 51 located on guide rails 35 and 36, whose function is to provide a fastening attachment for the mattress means shown generally at 62, when the convertible sofa bed is in the sofa configuration, as will be described hereinafter. One such dowel 51 is shown clearly in FIG. 2.

Figure 1:
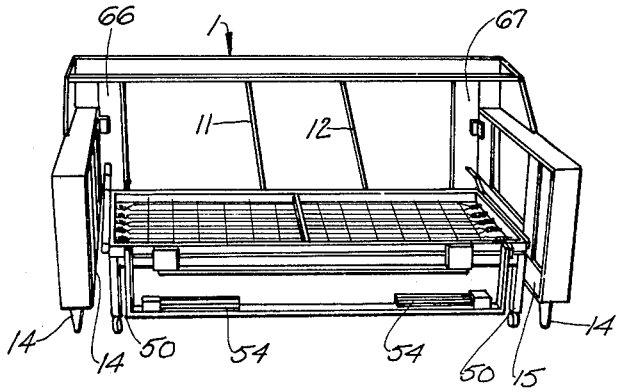
FIG. 1 is a perspective view of the convertible sofa bed of the present invention in its retracted or sofa configuration with the mattress removed.

Second telescoping section 4 is also provided with a folding foot board section, shown generally at 5, which provides a convenient kick plate when the sofa bed is in the sofa configuration, and may also provide extra bed length when the first and second telescoping sections 3 and 4 are fully extended to form a bed. Foot board section 5 consists of a rectangular foot board frame 52 supported at its front corners by a pair of folding legs 54. Each folding leg 54 is hinged to foot board frame 52 as at 55, so that when the convertible sofa bed is in the sofa configuration, as is best shown in FIGS. 1 and 3, the legs are folded inwardly, assuming a position parallel to foot board frame member 52*a*. When the convertible sofa bed is in the bed configuration, legs 54 fold downwardly and outwardly as is best shown in FIGS. 4 and 5, and are locked in position by locking mechanisms 56, in the manner of folding card table legs, as is well understood in the art. Foot board section 5 attaches at its rearmost corners to frame member 4*b* by means of double hinged members generally indicated at 57. Each hinge member 57 comprises a rectangular link 59 which is rotatably attached to a projecting tab 60 on the outside corner of frame member 4*b*. The opposite end of link 59 is rotatably attached to a similar tab 61 projecting perpendicularly to foot board section frame member 52*b*. Double hinged members 57 permit the foot board section 5 to assume the position shown in FIG. 3 when the sofa bed is in the sofa configuration, such that foot board section 52*d* extends above second telescoping frame member 4*b* by an amount approximately equal to the thickness of mattress 62. When the sofa bed is in the bed configuration, hinge members 57 permit foot board section 5 to assume a position essentially coplanar with second telescoping section 4, as is best shown in FIG. 5, thereby permitting foot board section 5 to be used as extra bed length in conjunction with a suitable mattress extension means (not shown). When extra bed length is not required, the foot board section need not be erected.

When the sofa bed is in the bed configuration, as is best shown in FIG. 5, mattress means 62, which may consist of a resilient foam mattress, as is well known in the art, assumes a substantially flat position extending from second telescoping section frame member 4*b* to the lowermost ends of guide members 11 and 12 to provide a comfortable sleeping surface. When the sofa bed is retracted to its sofa configuration, head portion 63 of mattress means 62 is manually slid upwardly and rearwardly along guides 11 and 12 to assume the position shown in FIG. 3. The foot end 64 of mattress means 62, which comprises approximately one third of the total mattress length, is folded back upon itself to form the comfortable double thickness seat cushion portion of the sofa as appears in FIG. 3. The folded area 62*a* of mattress means 62 may comprise a foam or other resilient material having a lesser density than the rest of the mattress, thus permitting the mattress to be easily folded upon itself. There is attached to the outer edges of mattress means 62 a pair of straps 65, one of which is located on each side of mattress means 62, which engage rod-like connectors 51 to hold mattress means 62 securely in its folded position. It will be understood by one skilled in the art that suitable upholstery and decorative cushions or pillows may be added to further enhance the comfort, appearance and utility of the sofa.

In order to simplify storage and shipment, the sofa bed may be partially disassembled or "knocked-down" into five component parts. One part comprises stationary frame section 9, first telescoping frame section 3 and second telescoping frame section 4; another part comprises the back rest frame 6; another part comprises foot board section 5; and two parts comprise arm rest frames 15 and 16.

Figure 8:
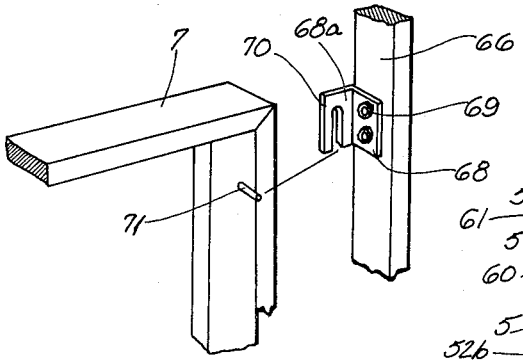
FIG. 8 is an exploded fragmentary perspective view showing the arm rest frame and back rest frame attachment detail.

Back rest frame 6 is attached to arm rest frames 15 and 16 by slotted brackets 68, one of which is clearly illustrated in FIG. 8. Bracket 68 is generally L-shaped, and is attached to stiffiner 66 by any suitable fastening means, such as nuts and bolts 69. The outwardly extending leg 68*a* of bracket 68 contains a pair of downwardly sloping parallel slots 70, which engage a pair of spaced pins 71 projecting from the inner face of arm rest frame 7 when the sofa bed is assembled. It will be understood that the attachment between stiffiner 67 and arm rest frame 8 is substantially identical. To remove the back rest frame 6 from arm rest frames 7 and 8, the back rest frame 6 is lifted and moved transversely to arm rest frames 7 and 8.

Arm rest sections 7 and 8 may be attached to stationary frame 9 by any suitable fastening means, not shown, such as wing nuts and bolts, which can be rapidly disengaged to remove the arm rest frames 7 and 8.

Similarly, footboard section 5 may be secured to second telescoping section 4 by means of wing nuts or similar fasteners, not shown, which rotatably connect link 59 to tabs 60 and 61, and which can be rapidly removed to effect disassembly. The five resulting disassembled parts may then be stacked for storage or shipment, thus occupying minimal space.

Modifications may be made in the invention without departing from the spirit of it.

The embodiments of the invention in which an exclusive property or privilege is claimed are defined as follows:

1. A convertible sofa-bed having a retracted and extended position comprising in combination, a horizontal stationary section, a first telescoping section, first guide means operatively connecting said first telescoping section to said stationary section, a second telescoping section, second guide means operatively connecting said second telescoping section to said first telescoping section, said first and second guide means acting to dispose said first and second telescoping sections on opposite sides of said stationary section when said sofa-bed is in the retracted position, and said guide means serving to dispose said first telescoping section, said second telescoping section and said stationary section in substantially coplanar positions relative to each other when said sofa-bed is in the extended position.

2. The sofa-bed according to claim 1 wherein said second telescoping section overlies said first telescoping section.

3. The sofa-bed according to claim 2 wherein said stationary section comprises a U-shaped frame mounting a flat, self-sustaining resilient rectangular support.

4. The sofa-bed according to claim 3 wherein the rearmost edge of said support is affixed to said U-shaped frame, and the frontmost edge of said support rides upon the upper surface of said second telescoping section.

5. The sofa-bed according to claim 4 wherein said support comprises a sheet of perforated metal mesh.

6. The sofa-bed according to claim 1 including an arm rest and back support section removably mounting said stationary section.

7. The sofa-bed according to claim 6 wherein said back rest and arm support section comprises a vertical rectangular back rest frame and two arm rest frames, and means detachably connecting said arm rest frame to said back rest frame.

8. The sofa-bed according to claim 7 wherein said connecting means each comprises at least one pin extending transversely of said arm rest frame and an L-shaped bracket having a first leg rigidly affixed to said back rest frame and a second leg containing at least one slot adapted to engage said at least one pin.

9. The sofa-bed according to claim 1 wherein said first guide means includes a hollow enclosure affixed to said first telescoping section and a rod-like member mounted on said stationary section adapted to slidably engage said enclosure.

10. The sofa-bed according to claim 9 wherein one end of said rod-like guide member is flanged and wherein said enclosure contains a flange-engaging restriction preventing removal of said rod-like member therefrom.

11. The sofa-bed according to claim 10 wherein said rod-like guide member is adjustable in length.

12. The sofa-bed according to claim 1 wherein said first guide member includes a lazy - tong equalizer.

13. The sofa-bed according to claim 1 including a footboard section comprising a rectangular frame, hinge means attaching said frame to said second telescoping section, a pair of folding legs pivotally affixed to said frame for movement from a folded to an unfolded position, and locking means to retain said legs in the unfolded position.

14. The sofa-bed according to claim 13 wherein said hinge means comprises a first tab projecting transversely of said frame, a link pivotally connected to said first tab, and a second tab projecting from said telescoping section and pivotally connected to said link.

15. The sofa-bed according to claim 14 including means for removably attaching said footboard section to said second telescoping section.

16. The sofa-bed according to claim 1 including a mattress having a folded and unfolded position and comprising a resilient rectangular mat with at least one area of reduced density defining a line of fold for said mattress.

17. The sofa-bed according to claim 7 including a mattress and mattress storage means comprising a plurality of guides angularly disposed between said stationary section and said back rest frame adapted to support said mattress when said sofa-bed is in te retracted position, straps connected to said mattress, and a pair of connectors extending from said second telescoping section adapted to engage said straps.

18. The sofa-bed according to claim 1 wherein said second guide means includes a pair of guide rails positioned along opposite sides of said second telescoping section, and a plurality of guide rail supports disposed along opposite sides of said first telescoping section and slidably communicating with said guide rails.

19. The sofa-bed according to claim 18 wherein said guide rials each comprises a Z-shaped member having a first vertical leg rigidly affixed to said second telescoping section, a horizontal section riding upon said guide rail support, and a downwardly depedning leg paralleling the line of travel of said second telescoping section.

20. The sofa-bed according to claim 19 wherein said guide rails each includes locking means for retaining said sofa-bed in the extended position.

21. The sofa-bed according to claim 20 wherein said locking means comprises a vertically offset portion of said guide rail.

22. The sofa-bed according to claim 21 wherein said guide rail supports comprise rotatably mounted wheels.

23. The sofa-bed according to claim 1 wherein said second guide means includes a lazy - tong equalizer.

* * * * *